United States Patent [19]

Allbäck

[11] Patent Number: 4,582,540

[45] Date of Patent: Apr. 15, 1986

[54] METHOD FOR REMOVING GLAZING PUTTY FROM WINDOWS

[75] Inventor: Hans C. Allbäck, Sjöbo, Sweden

[73] Assignee: Utvecklings AB Carmen, Sjöbo, Sweden

[21] Appl. No.: 691,530

[22] PCT Filed: Apr. 12, 1984

[86] PCT No.: PCT/SE84/00134

§ 371 Date: Dec. 28, 1984

§ 102(e) Date: Dec. 28, 1984

[87] PCT Pub. No.: WO84/04345

PCT Pub. Date: Nov. 8, 1984

[30] Foreign Application Priority Data

May 3, 1983 [SE] Sweden ..... 8302506

[51] Int. Cl.[4] ..... B08B 7/00

[52] U.S. Cl. ..... 134/1; 144/380; 134/6

[58] Field of Search ..... 134/1, 5, 6, 19, 38; 144/380, 144.5; 30/276

[56] References Cited

U.S. PATENT DOCUMENTS 3,623,909 11/1971 Jones ..... 134/5
4,028,135 6/1977 Vig et al. ..... 134/1
4,188,723 2/1980 Fuchs ..... 144/144.5

FOREIGN PATENT DOCUMENTS 772033 4/1957 United Kingdom .

*Primary Examiner*—Richard V. Fisher
*Assistant Examiner*—Sharon T. Cohen

[57] ABSTRACT

A method of removing putty from windows by heating the putty until it softens, by means of infrared radiation (4) which is focused onto the putty, and the putty thus heated by infrared radiation is scraped away. Use may be made of an infrared heating apparatus (1) having an elongate heating wire (2) and an elliptical reflector (3) for focusing the infrared radiation (4) thus produced in a focal line (5), the apparatus also having a spacer member (8) extending up to the focal line and having an elongate opening (9) essentially in the plane of the focal line for conducting the infrared radiation to the putty.

2 Claims, 2 Drawing Figures

METHOD FOR REMOVING GLAZING PUTTY FROM WINDOWS

The present invention relates to a method for removing glazing putty from windows.

The conventional technique of removing glazing putty in the renovation of windows includes chipping or scraping away the putty strand with a chisel. It is a well-known fact that removing the putty in this manner, without damaging the window casement and cracking the pane, is very difficult and hard work, especially when it is important that the pane be maintained intact, for instance in antique windows with hand-blown glass.

The present invention aims at obviating the above-mentioned difficulties and to provide a method by which the glazing putty can be removed quickly and simply without damage to the glass.

The invention is based on the discovery that also old and hard putty can be softened by heating with infrared radiation, whereupon the putty can be readily removed, and that the infrared radiation selectively heats the putty without heating the glass.

It should be emphasized that heating by infrared radiation (IR radiation) is characteristic of the present invention. Thus, if one tries to plasticise the putty by heating in some other manner, for example by means of a hot air blast, the pane will inevitably crack because of the thermal stresses arising in the glass. Besides, a large amount of excess heat is generated so that this technique is uncomfortable and disagreeable to work with. The hot air also destroys any paint on the casement through blistering and flaking so that the casement must be repainted. By using IR radiation, in accordance with the present invention, it has quite surprisingly been found that the IR radiation quickly and efficiently heats the putty, but in effect not the pane. This means that the putty can be heated without cracking the pane. It is true that the paint on the casing will be heated by the IR radiation, but also this problem has been eliminated by focusing, in accordance with the present invention the IR radiation to the putty strand.

Figure 1:
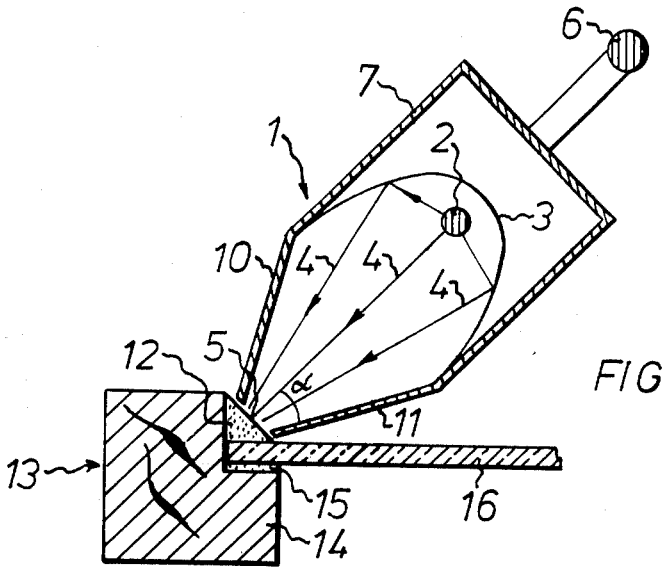
Figure 2:
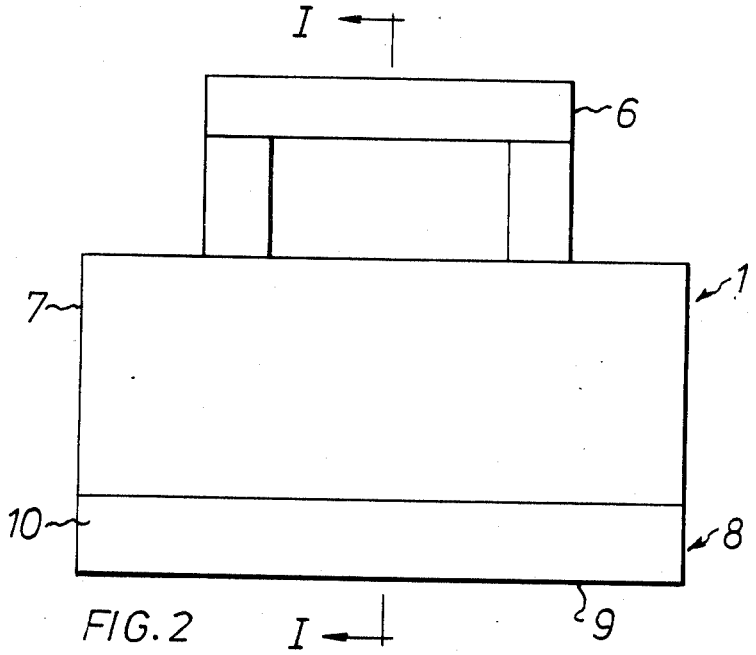

To facilitate understanding of the invention, it will be described in more detail below, reference being had to the accompanying drawings in which FIG. 1 is a schematic cross-sectional view, taken along line I—I in FIG. 2, of an apparatus for removing glazing putty from a window, in accordance with the method of the present invention. FIG. 2 is a lateral view of the apparatus shown in FIG. 1.

The apparatus shown in FIGS. 1 and 2 consists basically of an IR heating apparatus having an elongate heating wire 2 which in FIG. 1 is shown in cross-section, and an elliptical reflector 3 focusing the IR radiation 4 in a focal line 5. The apparatus has a carrying handle 6, an outer casing 7 and, furthermore, is provided at its front end located at the focal line 5 with a spacer member 8. The spacer member 8 serves to place the apparatus during use at the correct distance from the putty strand on the window. To this end, the spacer member 8 extends up to the focal line 5 and terminates in the same plane as the focal line or slightly before so that the IR radiation can be focused onto or in the putty strand. Furthermore, to make the IR radiation impinge upon the putty strand at the most favorable angle, the spacer member preferably is in the form of a nozzle casing having an elongate opening 9 which is surrounded by elongate lateral surfaces 10, 11 converging towards said opening. The angle ($\alpha$) between a converging lateral surface 11 and a plane extending through the focal line 5 and the heating wire 2 is such that the focal line of the IR radiation will impinge upon the putty when the elongate opening 9 of the spacer member 8 is placed upon the putty with the lateral edges of the opening 9 resting against the putty strand 12. Furthermore, the value of the angle $\alpha$ should be selected such that, when the lateral edges of the opening 9 rest against the putty strand 12, the lateral surface 11 is slightly spaced from the pane 16 to avoid scratching the glass when the apparatus is moved along the putty strand 12. The angle $\alpha$ preferably is about 30°–45°.

It should be emphasized that the apparatus has been illustrated but schematically in FIGS. 1 and 2, and that such conventional details as the connections for supplying electrical energy to the heating wire 2 have been left out.

During use, the apparatus for carrying the method according to the present invention into effect is held by one hand and applied, as shown in FIG. 1, to the putty strand 12 of a window 13 which is but schematically and partly shown in FIG. 1 and which comprises, in addition to the putty strand 12, a window casement 14, a putty strand 15 between the casement and the pane 16, and the outer putty strand 12. By placing the front end of the spacer member with the opening 9 against the putty strand 12, the correct distance and angle relative to the putty strand 12 for heating the latter is obtained. By focusing the IR radiation and the lateral surface 10 of the spacer member, unnecessary heating of the casement 14 laterally of the putty strand 12 is avoided. As has been mentioned before, the pane 16 remains substantially unaffected by the IR radiation.

When the IR heating apparatus has been placed in the manner shown in FIG. 1 and started, the IR radiation will immediately heat the putty 12 so that it softens, and by smoothly moving the apparatus 1 along the putty strand 12 and in direct conjunction therewith scraping away the softened putty with a chisel or scraping iron, the putty can be readily, quickly and completely removed. After that, the pins normally holding the pane in position are removed, whereupon the pane can be lifted out, and the putty strand 15 underneath the pane 16 can be removed. It is pointed out that the removal of the putty strand 15 underneath the pane 16 constitutes a particular advantage of the present invention, which is made possible by the fact that the putty strand 15 can be heated and plasticised by IR radiation through the pane 16 without heating the pane and causing it to crack. This has not been possible before because any attempt at conventionally heating the putty strand 15 has resulted in a cracked pane 16.

In addition to the complete renovation of windows, i.e. the removal of all existing old putty and reputtying of the window, the invention may be used for reconditioning windows with cracked and leaking putty strands. For such reconditioning, the putty is not removed, but merely is heated so that it softens and slightly flows out so that a smooth and tight putty strand is reestablished.

As will appear from the above description, the present invention offers a simple, efficient and highly labor-saving solution of the ancient problem of removing putty from windows. Although the invention has been described above with reference to the especially preferred embodiment illustrated in the drawing, it will be appreciated that various modifications can be made within the scope of the invention as defined by the appended claims.

I claim:

1. A method of removing putty from a window frame, comprising the steps of: focussing infrared radiation onto the putty to thereby heat only the putty until its softens, and scraping away the softened putty.

2. A method of removing from a window a first strand of putty betweeen one side of a pane and a window frame and a second strand of putty between the other side of the pane and the window frame, comprising the steps of: focussing infrared radiation onto the first strand of putty to thereby heat the same until it softens, scraping away the softened first strand of putty, focussing infrared radiation onto the second strand of putty through the pane to thereby heat the second strand of putty until it softens, and scraping away the second strand of putty.

* * * * *